US005323633A

United States Patent [19]

Bogart et al.

[11] Patent Number: 5,323,633

[45] Date of Patent: Jun. 28, 1994

[54] APPARATUS AND METHOD FOR ORIENTING A CURVED WORKPIECE

[75] Inventors: Michael W. Bogart, Bridgeport; Richard J. Smith, West Haven, both of Conn.

[73] Assignee: United States Surgical Corporation, Norwalk, Conn.

[21] Appl. No.: 959,050

[22] Filed: Oct. 9, 1992

[51] Int. Cl.[5] ..... B21D 43/00; B21G 3/28; B21G 3/32

[52] U.S. Cl. ..... 72/416; 72/428; 72/420; 163/1; 163/5; 414/18; 414/224

[58] Field of Search ..... 72/416, 407, 420, 428, 72/420; 163/1, 5; 414/18, 224, 222

[56] References Cited

U.S. PATENT DOCUMENTS

| | | | |
|---|---|---|---|
| 249,822 | 11/1881 | Berry | 163/1 |
| 2,005,589 | 6/1935 | McCoy | 414/18 |
| 3,443,414 | 5/1969 | Kull | 414/18 |
| 4,501,063 | 2/1985 | McNeely | 414/224 |
| 4,534,202 | 8/1985 | Snyder | 72/428 |
| 4,801,234 | 1/1989 | Cedrone | 414/224 |

FOREIGN PATENT DOCUMENTS

| | | | |
|---|---|---|---|
| 764805 | 9/1980 | U.S.S.R. | 72/428 |

*Primary Examiner*—Daniel C. Crane

[57] ABSTRACT

An apparatus for presenting a curved workpiece to a workstation, includes a frame member and a guide channel associated with the frame member for receiving a curved workpiece in a generally upright position. A first pusher mechanism is reciprocally movable in a transverse direction relative to the guide channel for engaging and positioning the workpiece against a bearing surface of the guide channel. A second pusher mechanism is advanceable within the guide channel to engage the workpiece and to advance the workpiece to the workstation. The apparatus has particular application in the manufacture of curved surgical needles.

30 Claims, 8 Drawing Sheets

APPARATUS AND METHOD FOR ORIENTING A CURVED WORKPIECE

BACKGROUND OF THE INVENTION

1. Field of the Invention

The present invention relates to an apparatus for orienting a curved workpiece at a workstation. In particular, the invention relates to an apparatus for presenting a curved surgical needle blank at a work station in a predetermined orientation during needle manufacture.

2. Discussion of the Prior Art

The manufacture of surgical needles involves many processing steps to transform the raw needle stock into a highly precisioned surgical needle product. Some of these processes include straightening, cutting, shaping, grinding, boring, pressing and coating operations.

Presently, surgical needle manufacture is carried out at a series of workstations. Each station is equipped with appropriate machinery to perform the desired process on the needle blank. The equipment presently used for needle manufacture requires a relatively high degree of manual intervention to operate the apparatus as well as to present and orient the needle blank with respect to the operative components of the equipment.

Recently, emphasis has been placed on automating the manufacture of surgical needles. The benefits of automation are readily apparent, i.e., increased productivity and a decrease in the number of rejected units. However, attempts towards automating needle manufacture have not proved to be as successful as initially envisioned. This is particularly attributed to the inability of design engineers to develop manufacturing equipment which can position and present the needle in a desired orientation relative to the operative components of the equipment without necessitating some degree of manual intervention. In particular, with specific regard to the manufacture of curved surgical needles, design engineers have been unsuccessful in devising equipment having material handling features which can accommodate the curved configuration of the needle.

Accordingly, it would be desirable to provide an apparatus for needle manufacture which can present a curved needle in a predetermined desired orientation at a workstation. It would also be desirable to provide such an apparatus which can be readily adapted for use with a variety of needle manufacturing processes.

SUMMARY OF THE INVENTION

Generally stated, the present invention is directed to an apparatus for presenting a curved workpiece to a workstation. The apparatus comprises frame means, guide means associated with the frame means for receiving a curved workpiece in a generally upright position, first pusher means reciprocally movable in a transverse direction relative to the guide means for engaging and positioning the workpiece against a bearing surface of the guide means and second pusher means advanceable within the guide means for slidably advancing the workpiece and for presenting the workpiece in a predetermined rotational orientation at the workstation. The apparatus is particularly adapted for use in the manufacture of curved surgical needles.

The first pusher means defines an arcuate needle engaging surface dimensioned to engage the inner curved surface of the needle during an advancing movement thereof to position the needle against the bearing surface of the guide means. The arcuate engaging surface terminates at one end in a first generally horizontal positioning surface and at a second end in a second generally horizontal positioning surface. The first and second positioning surfaces are dimensioned to engage the first and second ends of the needle during an advancing movement of the first pusher means towards the guide means to position the needle in the predetermined rotational orientation within the guide means.

The second pusher means comprises a needle engaging surface having a projecting member extending therefrom. The projecting member is positioned and dimensioned to engage the second end of the needle to retain the needle in the predetermined rotational orientation as the needle is advanced to the workstation. In an alternative preferred embodiment, the projecting member is positioned and dimensioned to permit slight rotational movement of the needle about a center axis of curvature defined thereby as the needle is advanced along its outer curved surface through the guide means. Such rotational movement of the needle positions the needle in the predetermined rotational orientation at the workstation.

The needle engaging surface of the second pusher means also includes an arcuate surface portion. The arcuate surface portion is particularly configured and dimensioned to increase surface contact between the engaging surface of the second pusher means and the outer curved surface of the needle to facilitate advancement of the needle to the workstation.

The apparatus further includes first and second drive means which are operatively connected to the first and second pusher means, respectively. The first drive means provides reciprocal movement to the first pusher means. The second drive means advances the second pusher means from an initial needle engaging position to a needle operating position adjacent the workstation. The second drive means may also be adapted to further advance the second pusher means from the needle operating position to a needle release position to expel the needle from the workstation. Preferably, the first and second drive means comprise pneumatic means.

The present invention is also directed to an apparatus for pressing at least a portion of a curved surgical needle. The apparatus comprises frame means, guide means associated with the frame means for receiving the needle in a generally upright position, first pusher means reciprocally movable in a general transverse direction relative to the guide means for engaging the inner curved surface of the needle to position the needle against a bearing surface of the guide means, second pusher means disposed within the guide means and longitudinally advanceable therewithin for slidably advancing the needle to present the needle in a predetermined rotational orientation at a workstation and side pressing means disposed at the workstation for pressing at least a portion of the needle.

The side pressing means comprises die means including first and second die members and die advancing means for advancing at least one of the die members towards the other member to press the needle. The die members each define a die face having first, second and third surfaces. The three surfaces are dimensioned and positioned to press the main portion of the needle while preserving the integrity of the pointed and butt ends.

The present invention is also directed to a method for presenting a curved surgical needle in a predetermined rotational orientation at a workstation. The method comprises the steps of placing the curved surgical needle in a generally upright position within a guide channel, advancing a first pusher member in a general transverse direction relative to the guide channel such that the first pusher member engages the inner curved surface of the needle to position the needle in a predetermined rotational orientation within the guide channel and advancing a second pusher member within the guide channel to advance the needle and present the needle in the predetermined rotational orientation at the workstation.

BRIEF DESCRIPTION OF THE DRAWINGS

The preferred embodiments of the invention are described hereinbelow with reference to the drawings wherein.

DETAILED DESCRIPTION OF THE PREFERRED EMBODIMENT(S)

Figure 1:
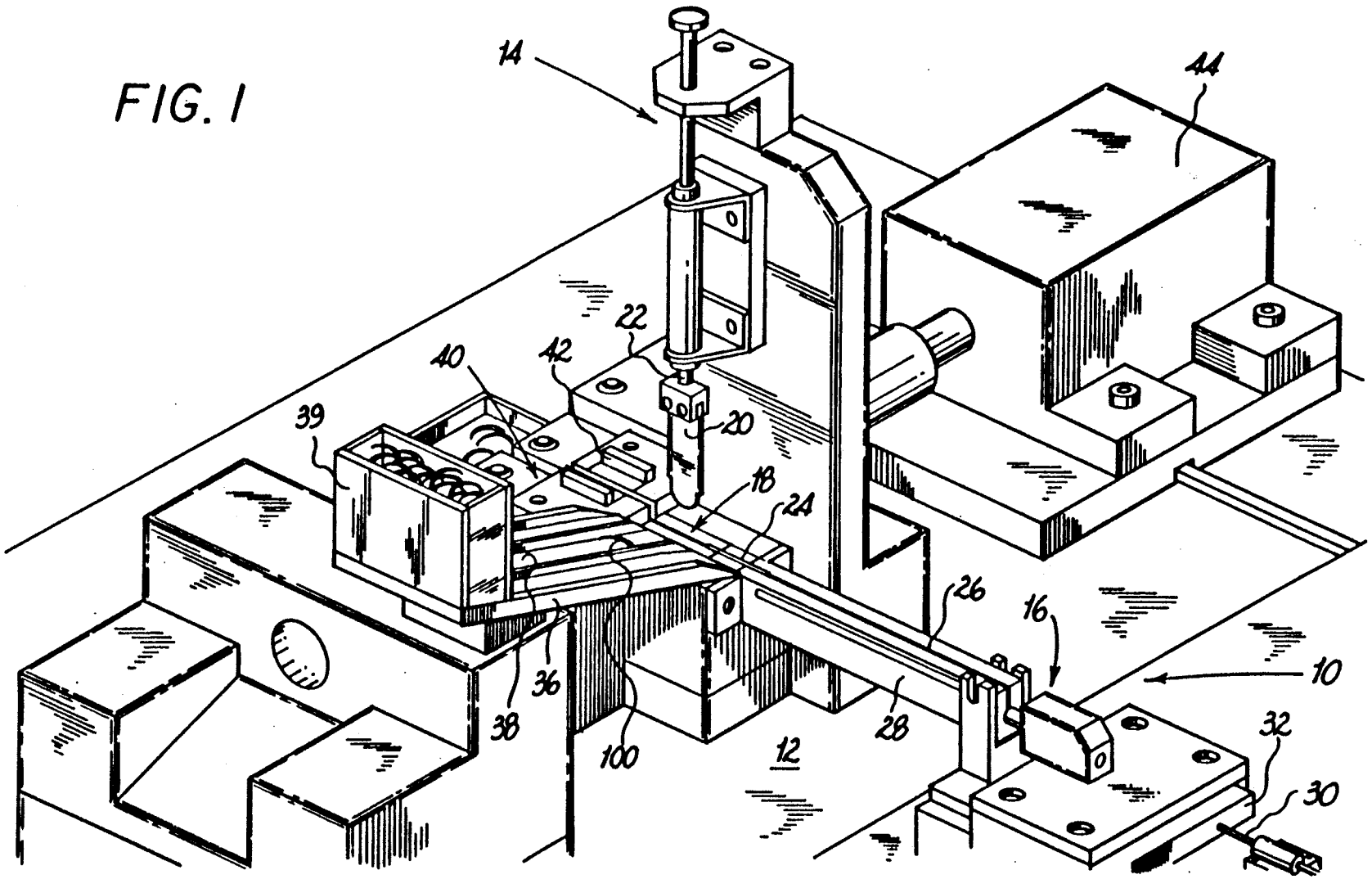
FIG. 1 is a perspective view of an apparatus constructed according to the present invention for presenting a curved workpiece, e.g., a curved surgical needle, in a predetermined orientation at a pressing needle, in a predetermined orientation at a pressing operation.

Referring initially to FIG. 1, there is illustrated the apparatus 10 for presenting a curved workpiece in a predetermined orientation constructed according to the present invention. The apparatus 10 is equipped to perform a pressing operation on a curved surgical needle and will be described in accordance with such operation for exemplative purposes. However, it is to be appreciated that apparatus 10 may be used in conjunction with workstations designed to perform other needle manufacturing processes such as crimping, cutting, sharpening, coating, shaping, etc. It is also to be appreciated that apparatus 10 may be adapted to accommodate a variety of curved workpieces other than curved surgical needles.

Apparatus 10 includes frame 12 which supports a vertical pusher mechanism and a horizontal pusher mechanism identified generally by the reference numerals 14, 16 respectively, and a needle nest area identified generally by the reference numeral 18.

Vertical pusher mechanism 14 includes vertical pusher element 20 which is adapted for reciprocal transverse movement between a retracted position and an extended position. In the extended position, vertical pusher 20 engages a needle received within needle nest 18 and positions the needle in a desired rotational orientation therewithin. Vertical pusher 20 is operatively connected to piston 22. Piston 22 is a component of a drive mechanism which is adapted to provide such transverse movement. In the preferred embodiment, the drive mechanism preferably incorporates a pneumatic system.

Horizontal pusher mechanism 16 includes horizontal pusher 24 which is housed within a longitudinal slot 26 formed in pusher housing 28. Horizontal pusher 24 advances within slot 26 and into needle nest 18 to engage the needle positioned by vertical pusher 20, and to advance the needle to the workstation for the pressing operation. In the preferred embodiment, horizontal pusher 24 is also advanceable by a pneumatic system. In particular, a pneumatically operated piston 30 imparts motion to slide member 32, which is operatively connected to horizontal pusher 24 disposed within pusher housing 28. Consequently, movement of slide member 32 advances the horizontal pusher 24 through needle nest 18 and to the pressing operation. Horizontal pusher 24 may be connected to slide member 32 by conventional means.

The pneumatically operated horizontal pusher mechanism is preferably advanceable through two positions. The first position corresponds to a needle processing position wherein horizontal pusher 24 advances the needle from needle nest 18 to the workstation, i.e., where the pressing operation is performed. The second position corresponds to a needle release position wherein horizontal pusher 24 is further advanced to expel the needle from the workstation upon completion of the needle pressing step. The pneumatic system also includes an adjusting mechanism to control the distance horizontal pusher 24 advances within the apparatus. The adjusting mechanism includes piston stop 34 which is positioned on piston 30. The location of piston stop 34 may be adjusted on piston 30, which, accordingly, enables the operator to control the amount of advancing movement of horizontal pusher 24 and the positioning of the needle relative to the workstation. This feature provides a means for the operator to control the amount of surface portion of the needle engaged by the pressing surfaces of the dies as will be described below. It also facilitates in the adaption of the apparatus to other manufacturing processes. The location of piston stop 34 on piston 30 may be adjusted by conventional means, e.g., screw means or the like.

Referring still to FIG. 1, apparatus 10 also includes needle ramp 36 having feeding channel 38 to assist the operator in feeding the surgical needle 100 within needle nest 18. Preferably, the width of feeding channel 38 is substantially equal to or slightly greater than the diameter of the curvature of the needle to retain the needle in the position shown during introduction into needle nest 18. Such dimensioning of feeding channel 38 will ensure that the needle is in a generally upright position when received within needle nest 18 with its inner curved surface facing vertical pusher 20.

An automated feeding mechanism 39 is positioned adjacent ramp 36. Feeding mechanism 39 is adapted to sequentially deliver curved needle blanks to needle nest 18 via channel 38. Feeding mechanism may be a hopper mechanism or any other conventional device suitable for this purpose such as a conveyor system. Feeding mechanism 39 may also be adapted to directly feed the needles to needle nest 18.

Apparatus 10 also includes a pressing station 40 disposed adjacent needle nest 18. Pressing station 40 includes a pair of removable side pressing dies 42 which are in alignment with needle nest 18 to receive the needle advanced by horizontal pusher 24. A hydraulic press 44 advances dies 42 relative to each other to perform the pressing operation. Pressing station 40 also includes a die positioning mechanism (not shown) to adjust the vertical positioning of dies 42 relative to needle nest 18. This feature enables the operator to control the vertical positioning of the pressing surfaces of dies 42 relative to the needle so as to provide another means to control the amount of surface portion of the needle engaged by the pressing surfaces during the pressing operation. The die positioning mechanism may be in the form of an adjustable plate disposed beneath the dies or any other conventional means suitable for this purpose.

Figure 2:
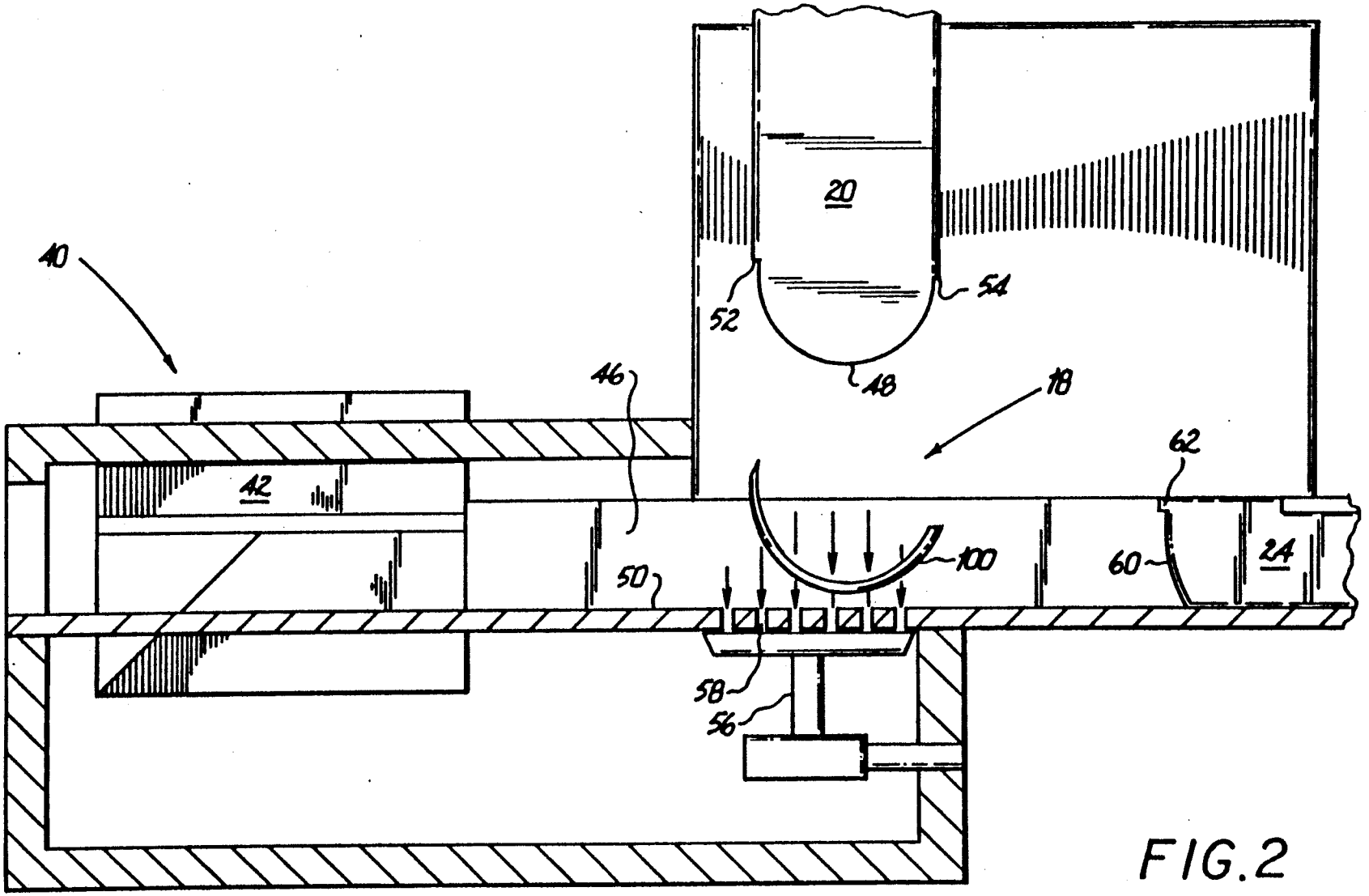
FIG. 2 is an enlarged cross-sectional view taken along the lines 2—2 of FIG. 1 illustrating the vertical and horizontal pusher elements of the apparatus of FIG. 1.

Referring now to FIG. 2, a cross-sectional view of the needle nest area 18 and the pressing station 40 is shown to illustrate the operation of the vertical and horizontal pusher mechanisms 14, 16 of the present invention. Needle nest 18 includes channel 46 formed therein to receive needle 100 which had been previously introduced via feeding ramp 36. Channel 46 is advantageously dimensioned to receive and retain the curved needle 100 in a generally upright and vertical position, i.e., in a position where the outer curved surface, rather than the point and butt ends of needle 100, can be positioned against bearing surface 50 of channel 46. The width of channel 46 is substantially equal to or slightly greater than the largest cross-sectional diameter of needle 100 to maintain the needle in a vertical position as well as to minimize side-to-side rocking motion of the needle during its advancement through the channel. Channel 46 is also in alignment with slot 26 of pusher housing 28 to accommodate horizontal pusher 24 and to guide the horizontal pusher during advancement through needle nest 18.

The lower surface of vertical pusher 20 defines an arcuate bearing surface 48 which engages the inner curved surface of needle 100 during an advancing movement to position the needle against lower bearing surface 50 of channel 46. Arcuate bearing surface 48 terminates at a first end thereof in a first horizontal positioning surface 52 and at a second end thereof in a second horizontal positioning surface 54. Positioning surfaces 52, 54 are adapted to engage each end of needle blank 100 during a downward movement of vertical pusher 20 to properly orient the needle blank within needle nest 18 in a manner so that it may be subsequently engaged by horizontal pusher 24. In the preferred embodiment, first and second positioning surfaces 52, 54 engage the pointed and butt ends of needle blank 100, respectively.

Arcuate bearing surface 48 of vertical pusher 20 preferably defines a radius of curvature which is slightly less than the radius of curvature of needle 100. Such particular dimensioning of arcuate surface 48 will decrease the potential for locking engagement between the arcuate surface and the inner curved surface of needle 100 during a downward engaging movement of vertical pusher 20, and, accordingly, minimize the potential that the needle will ride up with the vertical pusher as the pusher retracts to its initial retracted position.

Referring still to FIG. 2, apparatus 10 also possess a vacuum source 56 disposed beneath channel 46 of needle nest 18 and in alignment with vertical pusher 20. Vacuum source 56 provides a generally vertical flow of air (as shown by the arrows) towards lower bearing surface 50 of channel 46, which air flow communicates through perforations 58 formed in the lower bearing surface of the channel. This air flow assists in retaining needle 100 against bearing surface 50 during a retracting movement of vertical pusher 20. It is also possible for vacuum source 56 to extend along the length of channel 46 within needle nest 18 to assist in retaining needle 48 against bearing surface 50 during advancement to pressing operation 40.

The leading edge of horizontal pusher 24 defines needle bearing surface 60. Needle bearing surface 60 includes a projecting member 62 at its upper portion which engages the butt end of needle 100 during advancement of horizontal pusher 24 through channel 46 of needle nest 18. Projecting member 62 is appropriately dimensioned to prevent rotational movement of needle 100 as the needle is advanced to side pressing station 40 so as to present the needle in a predetermined rotational orientation within dies 42 as will be discussed below. Needle bearing surface 60 is preferably slightly arcuately-shaped. Such configuration increases the surface contact between bearing surface 60 and the outer curved surface of needle 100 to facilitate advancement of the needle through channel 46.

Further understanding of the significant aspects of the present invention will become more readily apparent by the following description of its operation.

Referring again to FIG. 2, apparatus 10 is shown in its unactuated position with needle 100 placed within channel 46 of needle nest 18 via ramp 36. Needle 100 is received within channel 46 in a generally upright position with its inner curved surface facing bearing surface 48 of vertical pusher 20. It is to be noted, however, that needle 100 is most likely in a somewhat misaligned position as shown and may or may not be in engagement with lower bearing surface 50 of channel 46.

Figure 3:
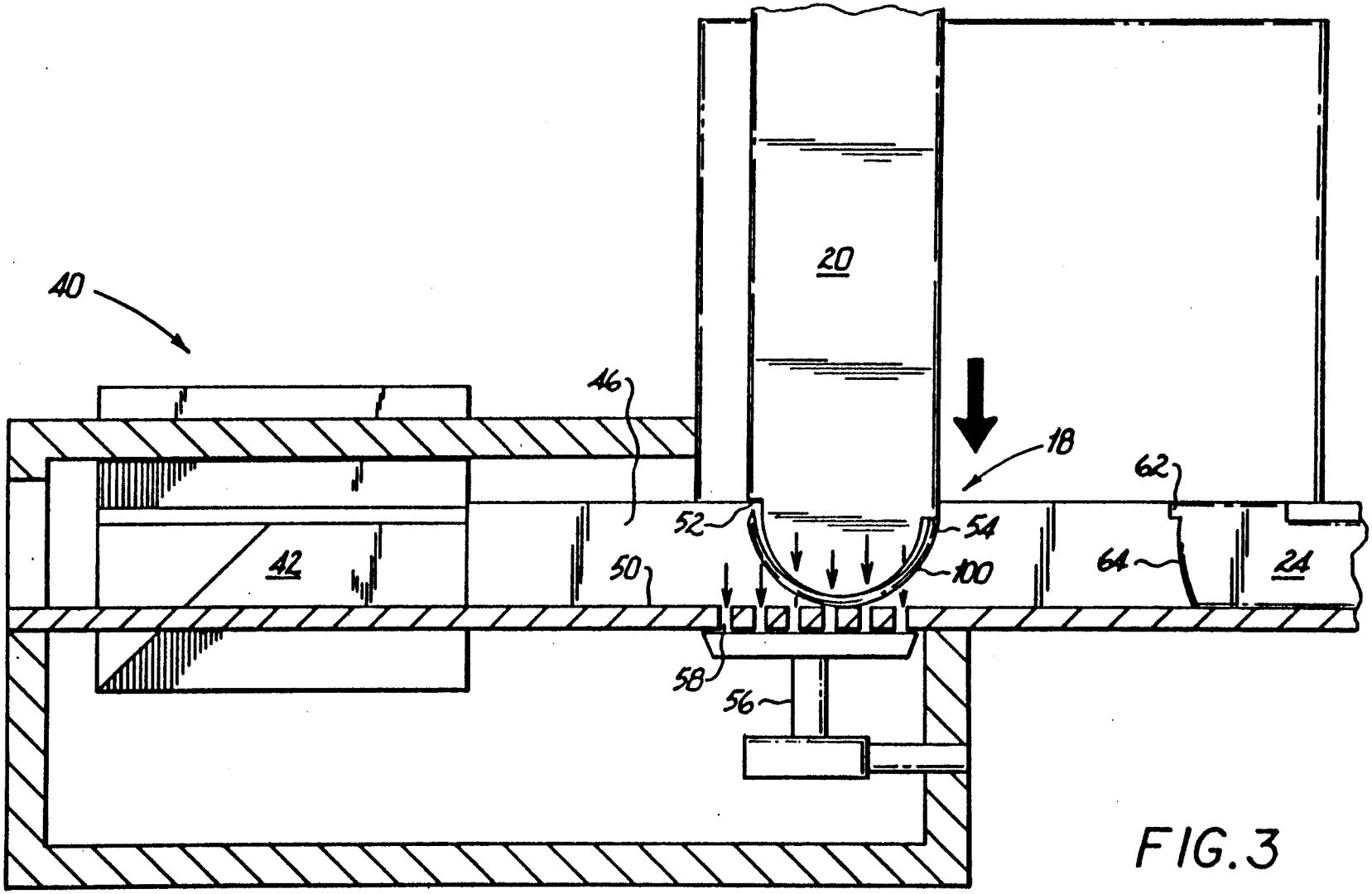
FIG. 3 is an enlarged cross-sectional view similar to FIG. 2 illustrating the downward needle engaging motion of the vertical pusher element.

Actuation of apparatus 10 initially effects movement of vertical pusher 20 from its initial retracted position to an extended position. During such movement, bearing surface 48 of vertical pusher 20 engages the inner curved surface of needle 100 and positions the needle against lower bearing surface 50 of channel 46, while positioning surfaces 52, 54 engage the pointed and butt ends of needle 100, respectively, to position the needle in a desired rotational orientation within needle nest 18 for subsequent engagement by horizontal pusher 24. FIG. 3 illustrates vertical pusher 20 in the fully extended position and needle 100 in the desired rotational orientation with its outer curved surface in contact with bearing surface 50 of channel 46.

Figure 4:
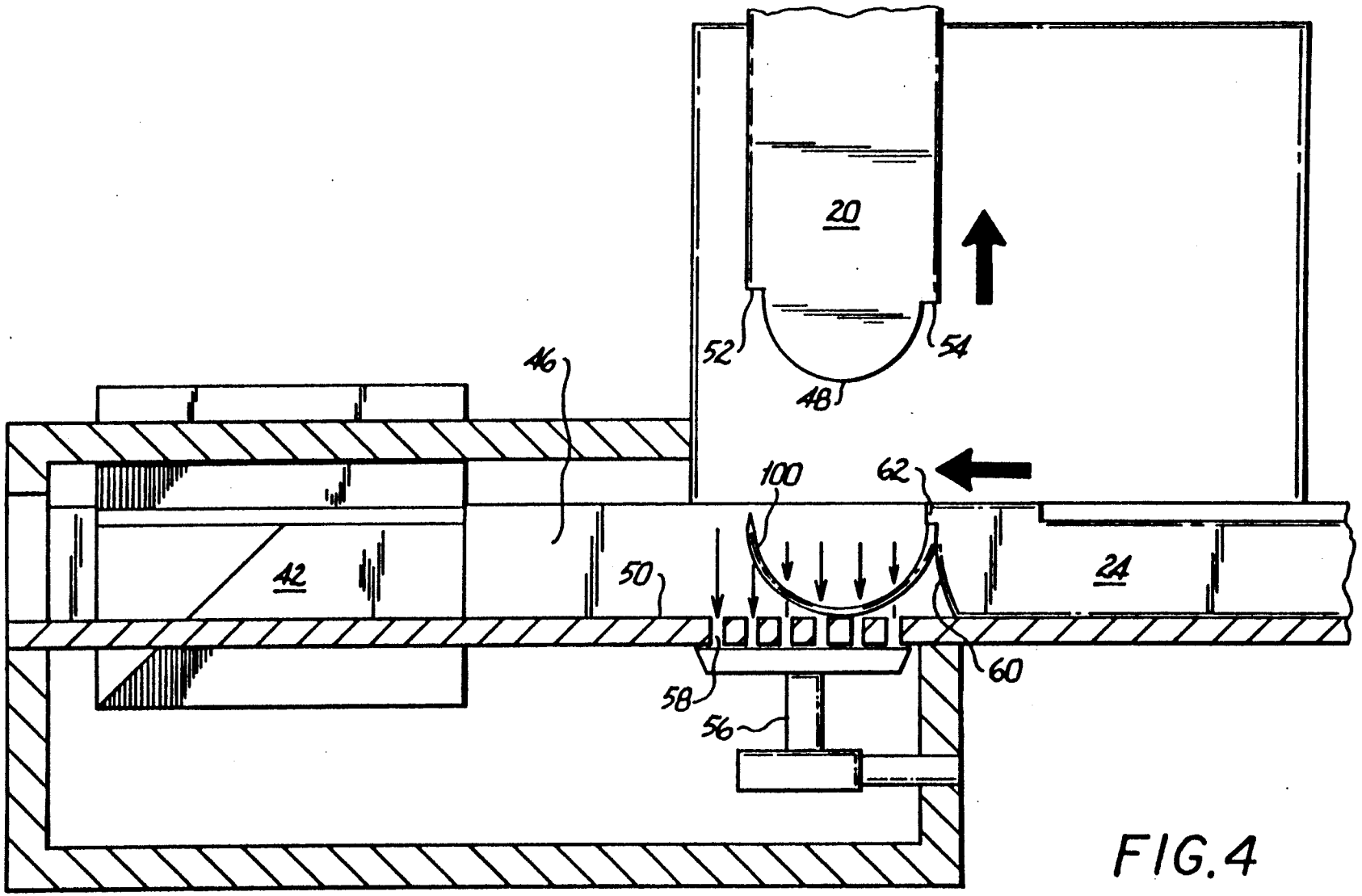
FIG. 4 is an enlarged cross-sectional view similar to FIG. 3 illustrating the horizontal needle engaging motion of the horizontal pusher element.

Referring now to FIG. 4, vertical pusher 20 is shown in its retracted position while horizontal pusher 24 is shown advanced and engaged with needle 100 in nest 18. During retracting movement of vertical pusher 20, needle 100 is retained against bearing surface 50 of channel 46 by the air flow created by vacuum source 56 and prevented from riding up with the vertical pusher by the relative dimensioning of arcuate bearing surface 48 and the inner curved surface of needle 100.

Figure 5:
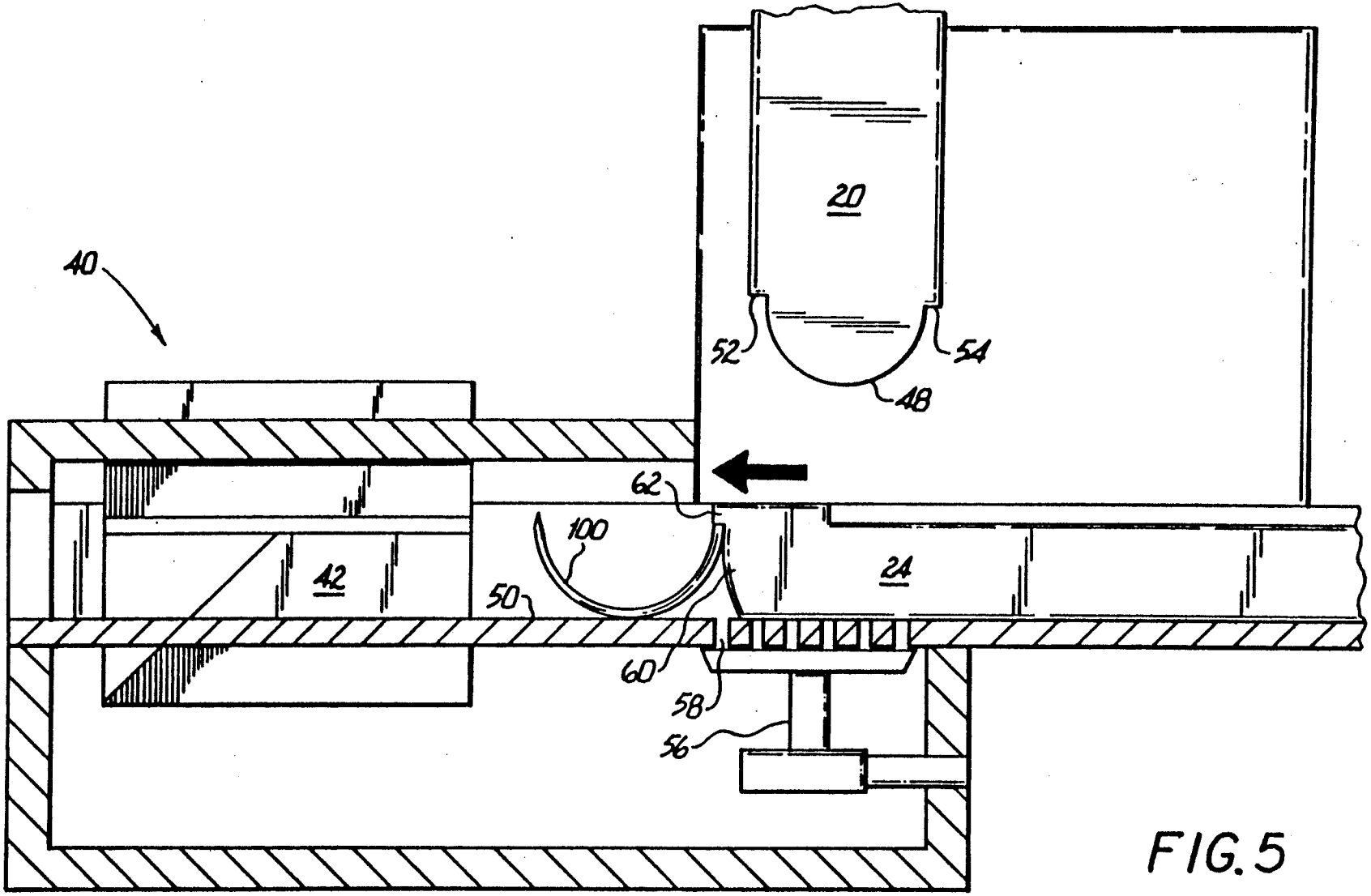
FIG. 5 is an enlarged cross-sectional view similar to FIG. 4 illustrating the horizontal pusher element advancing the curved surgical needle towards the pressing operation.
Figure 6:
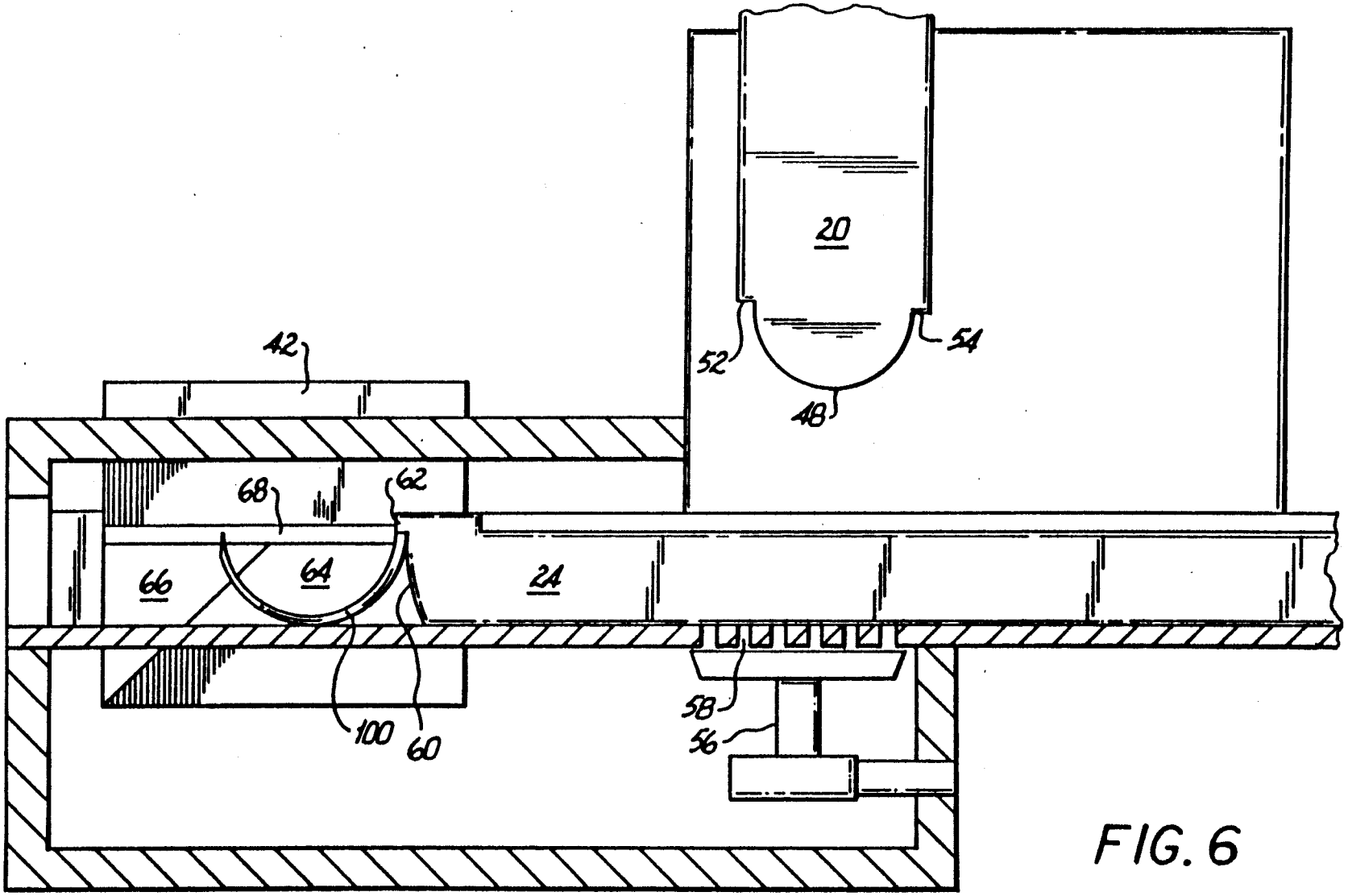
FIG. 6 is an enlarged cross-sectional view similar to FIG. 5 illustrating the horizontal pusher element positioning the curved surgical needle in a predetermined orientation at the pressing operation.

Referring now to FIG. 5, horizontal pusher 24 further advances through needle nest 18 to move needle 100 towards dies 42. As needle 100 is advanced along its outer curved surface, the needle tends to rotate about its center of curvature in a counterclockwise direction due to the frictional forces realized between the contacting portion of the outer curved surface of the needle and bearing surface 50 of channel 46. However, such rotational movement of needle 100 is prevented by projecting member 62 of horizontal pusher 24. Specifically, projecting member 62 engages the butt end of needle 100 to retain the needle in the desired orientation. This ensures that needle 100 is presented in its proper rotational orientation within dies 42 at the pressing station 40 as shown in FIG. 6.

Thus, it is to be appreciated that the combined operations of vertical pusher element 20 and horizontal pusher element 24 position and transport needle 100 in a desired rotational orientation within dies 42 for the pressing operation. In the embodiment of the present invention previously described, the downward engaging movement of vertical pusher 20 positions needle 100 in a desired rotational orientation while horizontal pusher 24 retains the needle 100 in this desired orientation during advancement to the pressing operation.

In an alternative embodiment, projection 62 of horizontal pusher 24 may be appropriately dimensioned and positioned to permit slight rotational movement of needle 100 such that the needle assumes the desired rotational orientation during advancement along its outer curved surface towards pressing operation 40. Therefore, in accordance with this embodiment, vertical pusher 20 positions needle 100 within channel 46 in a generally oriented manner while horizontal pusher 24 positions the needle in the precise desired predetermined rotational orientation during advancement towards dies 42.

Figure 7:
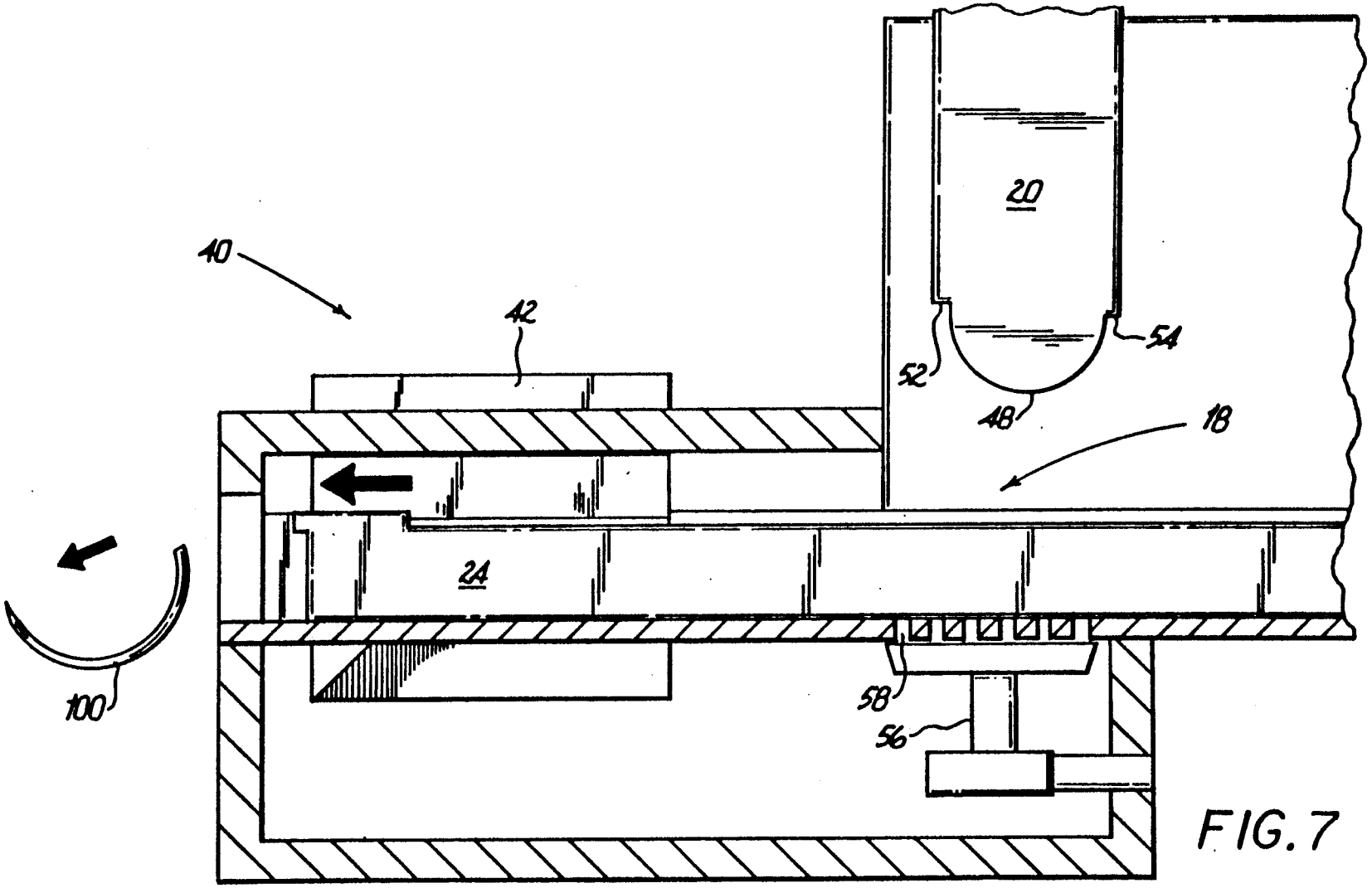
FIG. 7 is an enlarged sectional view similar to FIG. 6 illustrating the horizontal pusher element in a fully advanced position ejecting the curved surgical needle from the pressing operation.

Referring again to FIG. 6, with needle 100 in its predetermined rotational orientation within dies 42, the pressing mechanism 40 is activated to advance the dies relative to each other to strike the needle. Thereafter, needle 100 is removed from within dies by further advancement of horizontal pusher 24, which accordingly, expels the needle from within dies 42 as shown in FIG. 7.

Figure 8:
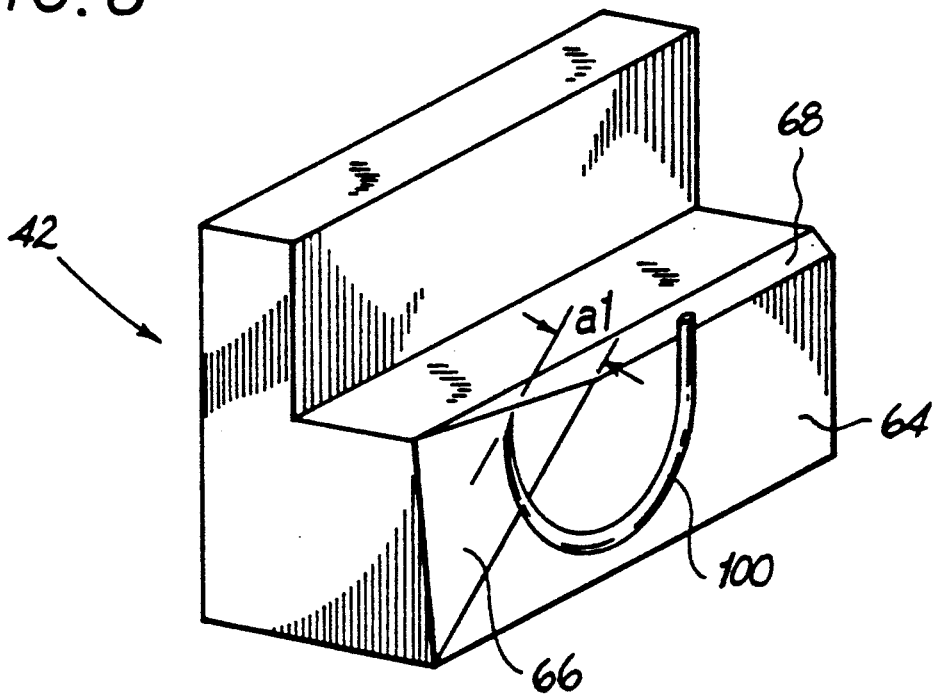
FIG. 8 is an enlarged perspective view of a die member of the pressing operation, illustrating the various die surfaces of the die engaging face with a needle disposed in the desired orientation within the die member.

Referring now to FIG. 8 in conjunction with FIG. 6, the novel configuration of die members 42 of pressing operation 40 is illustrated in detail. Die member 42 defines a die face having three surfaces, namely pressing surface 64, first tapered surface 66 and second tapered surface 68. Pressing surface 64 is dimensioned to engage the main portion of needle 100 during the pressing operation to form generally straight pressed surfaces on the needle. The pressed surfaces facilitate grasping of needle 100 with a grasping instrument during surgery. First tapered surface 66 is dimensioned to accommodate the pointed end of needle 100 during the pressing operation to prevent the needle point from being engaged by the die faces to preserve the integrity of the pointed end. Similarly, second tapered surface 68 is dimensioned to accommodate the butt end of the needle 100 during the pressing operation to prevent the butt end from being engaged by the die faces as well.

Figure 9:
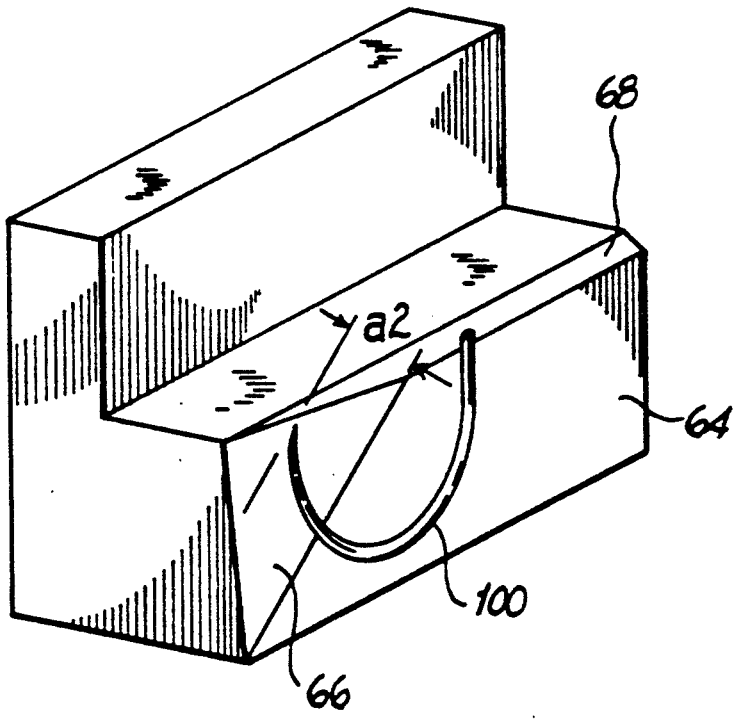
FIG. 9 is an enlarged perspective view of the die member of FIG. 8, illustrating the surgical needle in a slightly advanced position within the dies relative to the position of the needle in FIG. 8.

As previously described, the range of longitudinal movement of horizontal pusher 24 may be adjusted by altering the location of piston stop 34 on piston 30. (see FIG. 1). Accordingly, the positioning of needle 100 relative to dies 42 may also be adjustable so as to control the amount of surface portion engaged by pressing surfaces 64 of the dies. For example, in FIG. 8, piston stop 34 is adjusted to advance needle 100 such that the needle point is a distance "a1" from pressing surface 64. FIG. 9 illustrates needle 100 in an advanced position within dies 42 relative to the position of the needle within the dies in FIG. 8. In this advanced position, in which the needle point is a distance "a2" from pressing surface 64, the pressing surfaces engage a smaller portion of the needle surface as compared to the surface portion engaged by the dies when the needle is in the position shown in FIG. 8. It is also to be noted that the horizontal positioning of dies 42 may also be varied as previously described to provide another means to control the amount of surface portion engaged by the pressing surfaces.

Apparatus 10 preferably includes a control mechanism (not shown) for controlling the sequential operation of the vertical pusher 20, the horizontal pusher 24 and pressing station 40. The control mechanism may be a microprocessor of a known type which fully automates the operation of apparatus 10.

Apparatus 10 may be adapted to present a variety of different sized curved needles to a workstation. Vertical and horizontal pusher elements are readily removable from the apparatus and may be replaced with other comparable pusher elements having different dimensional features so as to accommodate different sized needles. The apparatus is not limited in terms of its use with a side pressing mechanism, but, can be readily adapted for use with other needle manufacturing operations.

While the above description contains many specifics, these specifics should not be construed as limitations on the scope of the invention, but merely as exemplifications of preferred embodiments thereof. Those skilled in the art will envision other possible variations that are within the scope and spirit of the invention as defined by the claims appended hereto.

What is claimed is:

1. An apparatus for presenting a workpiece having an arcuate surface portion to a workstation, which comprises:

frame means;

guide means associated with said frame means for receiving the workpiece;

first pusher means reciprocally movable in a transverse direction relative to said guide means, said first pusher means defining an arcuate surface corresponding generally in dimension to the arcuate surface portion of the workpiece and adapted to engage the arcuate surface portion of the workpiece during an advancing movement of said first pusher means to position the workpiece against a bearing surface of said guide means; and second pusher means advanceable within said guide means for slidably advancing the workpiece and for rotationally orientating the workpiece so as to present the workpiece in a predetermined rotational orientation at a workstation.

2. An apparatus, wherein the for presenting a curved surgical needle blank having inner and outer curved surfaces to a workstation, which comprises:

frame means;

guide means associated with said frame means for receiving the needle in a generally upright position;

first pusher means reciprocally movable in a transverse direction relative to said guide means, said first pusher means defining a needle engaging surface dimensioned to engage one of the inner and outer curved surfaces of the needle during an advancing movement of said first pusher means to position the needle against a bearing surface of said guide means; and second pusher means advanceable within said guide means for slidably advancing the needle and being configured and dimensioned to present the needle in a predetermined rotational orientation at a workstation.

3. The apparatus according to claim 2, wherein the needle is received within said guide means in a generally vertical position whereby a plane generally defined by the needle is generally transverse relative to a plane defined by said bearing surface of said guide means.

4. The apparatus according to claim 2, wherein said needle engaging surface of said first pusher means is generally arcuate in dimension and is adapted to engage the inner curved surface of the needle during the advancing movement of said first pusher means to position the needle against said bearing surface of said guide means.

5. The apparatus according to claim 4, wherein said arcuate engaging surface of said first pusher means terminates at one end in a first generally horizontal positioning surface and at a second end in a second generally horizontal positioning surface, said first and second positioning surfaces dimensioned to engage the first and second ends of the needle during the advancing movement of said first pusher means towards said guide means to position the needle in said predetermined rotational orientation within said guide means.

6. The apparatus according to claim 5, wherein said second pusher means comprises a needle engaging surface having a projecting member extending therefrom, said projecting member positioned and dimensioned to engage the second end of the needle to retain the needle in said predetermined rotational orientation as the needle is advanced to the workstation.

7. The apparatus according to claim 6, wherein said needle engaging surface of said second pusher means includes an arcuate surface portion configured and dimensioned to increase surface contact between said needle engaging surface of said second pusher means and the outer curved surface of the needle to facilitate advancement of the needle to the workstation.

8. The apparatus according to claim 4, wherein said second pusher means comprises a needle engaging surface including a projecting member extending in a generally longitudinal direction, said projecting member positioned and dimensioned to permit slight rotational movement of the needle about a center axis of curvature defined thereby as the needle is advanced along its outer curved surface through said guide means, whereby the rotational movement of the needle positions the needle in said predetermined rotational orientation.

9. The apparatus according to claim 4, wherein the radius of curvature of said arcuate engaging surface of said first pusher means is less than the radius of curvature of the surgical needle.

10. The apparatus according to claim 2, further comprising first drive means operatively connected to said first pusher means for providing reciprocal movement to said first pusher means.

11. The apparatus according to claim 10, wherein said first drive means comprises pneumatic means.

12. The apparatus according to claim 2, further comprising second drive means operatively connected to said second pusher means for advancing said second pusher means from an initial needle engaging position to a needle operating position adjacent the workstation.

13. The apparatus according to claim 12, wherein said second drive means is adapted to further advance said second pusher means from said needle operating position to a needle release position to expel the needle from the workstation.

14. The apparatus according to claim 13, further comprising means connected to said second drive means for adjusting the relative positioning of said needle operating position of said second pusher means.

15. The apparatus according to claim 13, wherein said second drive means comprises pneumatic means.

16. The apparatus according to claim 2, further comprising means disposed at the workstation for grasping the needle.

17. The apparatus according to claim 2, further comprising means disposed at the workstation for pressing at least a portion of the needle.

18. The apparatus according to claim 2, further comprising needle feeding means for sequentially feeding needles within said guide means.

19. The apparatus according to claim 3, further comprising vacuum means disposed beneath said guide means for retaining the needle against said bearing surface of said guide means during a retracting movement of said first pusher means.

20. An apparatus for presenting a curved surgical needle having inner and outer curved surfaces to a workstation, which comprises:

frame means;

guide means associated with said frame means for receiving the needle in a generally vertical position;

first pusher means reciprocally movable in a transverse direction relative to said guide means for engaging the inner curved surface of the needle to position the needle in a predetermined rotational orientation within said guide means; and second pusher means longitudinally advanceable within said guide means for slidably advancing the needle about its outer curved surface and for presenting the needle in said predetermined rotational orientation at a workstation.

21. An apparatus for pressing at least a portion of a curved surgical needle having inner and outer curved surfaces, which comprises:

frame means;

a guide channel having a lower bearing surface for receiving the needle in a generally vertical position whereby a plane generally defined by the needle is generally transverse relative to a plane defined by said bearing surface of said guide channel;

first pusher means reciprocally movable in a general transverse direction relative to said guide channel, said first pusher means defining a generally arcuate needle engaging surface dimensioned to engage the inner curved surface of the needle to position the needle against said bearing surface of said guide channel;

second pusher means disposed within said guide channel and longitudinally advanceable therewithin for slidably advancing the needle so as to present the needle in a predetermined rotational orientation at a workstation; and side pressing means disposed at the workstation for pressing at least a portion of the needle.

22. The apparatus according to claim 21, further comprising drive means operatively connected to said second pusher means, said drive means being adapted to advance said second pusher means within first and second positions, said first position corresponding to a needle operating position wherein the needle is advanced to said side pressing means, said second position corresponding to a needle release position wherein said second pusher means is further advanced to expel the needle from said side pressing means after activation of said side pressing means.

23. The apparatus according to claim 22, wherein said drive means comprises pneumatic means.

24. The apparatus according to claim 21, wherein said side pressing means comprises die means including first and second die members and die advancing means for advancing at least one of said die members towards the other said die member to press the needle.

25. The apparatus according to claim 24, wherein said die members each define a die face having first, second and third die surfaces, said first die surface defining a first plane and dimensioned to press a main portion of the needle during activation of said die advancing means, said second die surface defining a second plane which intersects said first plane defined by said first die surface, said second die surface dimensioned and positioned to accommodate the pointed end of the needle so as to prevent engagement of the pointed end with said die faces during activation of said die advancing means, said third die surface defining a third plane which intersects said first plane defined by said first die surface at an upper portion of said die face, said third die surface being dimensioned and positioned to accommodate the butt end of the needle so as to prevent engagement of the butt end with said die faces during activation of said die advancing means.

26. The apparatus according to claim 24, further comprising means for adjusting the vertical positioning of said die members relative to said guide means.

27. The apparatus according to claim 24, wherein said die advancing means comprises hydraulic means.

28. The apparatus according to claim 21, further comprising vacuum means disposed beneath said guide means for retaining the needle against said bearing surface of said guide means during a retracting movement of said first pusher means.

29. A method for presenting a curved surgical needle having inner and outer curved surfaces in a predetermined rotational orientation at a workstation, comprising the steps of:

placing the curved surgical needle in a generally upright position within a guide channel;

advancing a first pusher member in a general transverse direction relative to the guide channel such that said first pusher member engages the inner curved surface of the needle to position the needle in a predetermined rotational orientation within the guide channel; and advancing a second pusher member within said guide channel to advance the needle and present the needle in said predetermined rotational orientation at the workstation.

30. A method for side pressing a curved surgical needle having inner and outer curved surfaces, comprising the steps of:

feeding a curved surgical needle within a guide channel having a lower bearing surface such that the needle is in a generally upright position;

advancing a first pusher member in a generally transverse direction relative to the bearing surface of the guide channel such that said first pusher member engages the needle and positions the needle against the bearing surface of the guide channel;

advancing a second pusher member within the guide channel to advance the needle to a side pressing mechanism, said second pusher member presenting the needle in a predetermined rotational orientation within the side pressing mechanism; and activating the side pressing mechanism to press at least a portion of the needle.

* * * * *